US006085739A

United States Patent [19]

Leiss

[11] Patent Number: 6,085,739

[45] Date of Patent: Jul. 11, 2000

[54] HOT PRESSURE WASHER

[75] Inventor: Daniel Leiss, Somerset, Pa.

[73] Assignee: Jenny Products, Inc., Somerset, Pa.

[21] Appl. No.: 08/960,616

[22] Filed: Oct. 29, 1997

[51] Int. Cl.[7] ..... F24H 1/06; F23D 11/40

[52] U.S. Cl. ..... 126/350 C; 431/183; 431/154; 239/135

[58] Field of Search ..... 431/264, 265, 431/266, 183, 185, 188, 154; 126/391, 350 C; 239/135, 139

[56] References Cited

U.S. PATENT DOCUMENTS

| | | | |
|---|---|---|---|
| 2,128,263 | 8/1938 | Ofeldt | 239/135 |
| 2,393,897 | 1/1946 | Glendenning | 431/265 |
| 2,420,598 | 5/1947 | Jackson | 431/265 |
| 2,513,645 | 7/1950 | Hallinan | 431/183 |
| 2,546,402 | 3/1951 | Ofeldt | 431/266 |
| 2,987,259 | 6/1961 | Lindquist | 239/139 |
| 4,780,077 | 10/1988 | Lefebvre | 431/265 |

*Primary Examiner*—Ira S. Lazarus
*Assistant Examiner*—Sara Clarke
*Attorney, Agent, or Firm*—Carothers & Carothers

[57] ABSTRACT

A pressure washer having a frame supporting a heat exchanger for heating liquid passing therethrough under pressure for delivery to a nozzle for pressure cleaning. A burner unit is positioned for applying flame heat to the heat exchanger for heating liquid in the heat exchanger and a blower is provided for delivering combustion air under pressure to the burner unit. A fuel pump is also provided for supplying fuel under pressure to the burner unit. The burner unit is modular and remotely mounted on the frame from the blower and is readily removable and connected to the blower unit remotely through a duct. The burner unit includes a burner gun contained in a removable burner throat housing having a base with an air inlet for registration with the duct and an outer flame port for exposure of the flame from the burner gun to the heat exchanger. The fuel pump for supplying fuel to the burner is driven directly from the blower.

4 Claims, 4 Drawing Sheets

HOT PRESSURE WASHER

BACKGROUND OF THE INVENTION

The present invention pertains generally to pressure washers and more particularly to hot pressure washers, including steam cleaners, which are oil fired.

Hot pressure washers and steam cleaners have been in existence for over 70 years and are commonly used for many cleaning tasks, such as cleaning grease and oil from equipment, degreasing and sanitizing tanks and otherwise cleaning equipment, machinery and parts, such as truck fleets, farm and construction equipment and concrete floors.

The hot pressure washers generally provide water pressures from 750 psi to 3,500 psi and volumes from 2.3 g.p.m. to 5.0 g.p.m. The corresponding steam cleaners work in a somewhat different manner compared to hot pressure washers. Steam cleaners do not actually make steam in the sense of the word. They actually produce 85% to 90% solid water and the steam is simply a byproduct of creating pressure through heat. The primary difference between steam cleaners and pressure washers is that steam cleaners only attain pressures of 100–200 psi at a significantly reduced volume comparatively (70 to 120 g.p.h.). Steam cleaners use the 170 times water vapor expansion when the super heated water explodes into the atmosphere through the nozzle to achieve their cleaning power, whereas pressure washers simply use the pump pressure to achieve the similar result. The present invention pertains to both hot pressure washers and steam cleaners and reference to pressure washers hereafter includes both.

The main problem encountered with present day hot pressure washers and steam cleaners is that they are not easily disassembled and serviced. All of the prior art units incorporate a unitary blower-burner assembly which is difficult to access and repair, and they additionally require separate or special drive motors for pumping fuel and water.

It is a principal object of the present invention to provide a pressure washer, either of the hot pressure washer type or steam cleaner type, which is to devoid of the aforementioned disadvantages.

SUMMARY OF THE INVENTION

The pressure washer of the present invention includes a frame that supports the heat exchanger for heating the liquid passing therethrough under pressure for delivery to a nozzle. A burner unit, such as an oil burner, is also mounted on the frame for applying flame heat to the heat exchanger for heating liquid therein, and a blower is further mounted on the frame for delivering combustion air under pressure to the burner unit. A fuel pump is also provided to supply the fuel, such as fuel oil, under pressure to the burner unit. To this point, what is described are the basic components of a hot pressure washer or steam cleaner.

In the pressure washer of the present invention, the burner unit is remotely mounted on the frame from the blower as a readily removable modular unit and it is remotely connected to the blower through a duct. The burner unit includes a burner gun contained in a removable burner throat housing. The base of the throat housing is provided with an air inlet for registration with the air duct and an outer flame port is also provided in the throat housing for exposure of the flame from the burner gun to the heat exchanger elements.

A second feature of the pressure washer of the present invention is that a drive connects the blower to the fuel pump whereby the fuel pump is directly driven from the blower. For example, this may be accomplished by a belt drive.

Yet another feature of the pressure washer of the present invention is that a single motor mounted on the frame is connected for simultaneously driving the blower and a liquid pump also mounted on the frame for supplying liquid under pressure (such as water) to the heat exchanger.

The throat housing is basically comprised of a cylindrical sleeve having at least one side aperture adjacent the bottom of the sleeve which thereby provides the base air inlet for registration with the blower duct. The bottom of the sleeve is closed off so that air within the duct only registers with the desired air inlets of the throat housing. The throat housing guides combustion air under pressure to the burner nozzle.

This modular provision of components, i.e. separate burner, electrical and air systems, provides simplicity and serviceability heretofore unattainable. Easy serviceability is provided due to easy assembly and disassembly of the modular parts.

In addition, no separate or special drive motor is required to drive the fuel pump and water pump.

BRIEF DESCRIPTION OF THE DRAWINGS

The accompanying drawings show, for the purpose of exemplification, without limiting the invention or appended claims, certain practical embodiments of the present invention wherein:

DETAILED DESCRIPTION OF A PREFERRED EMBODIMENT

Figure 1:
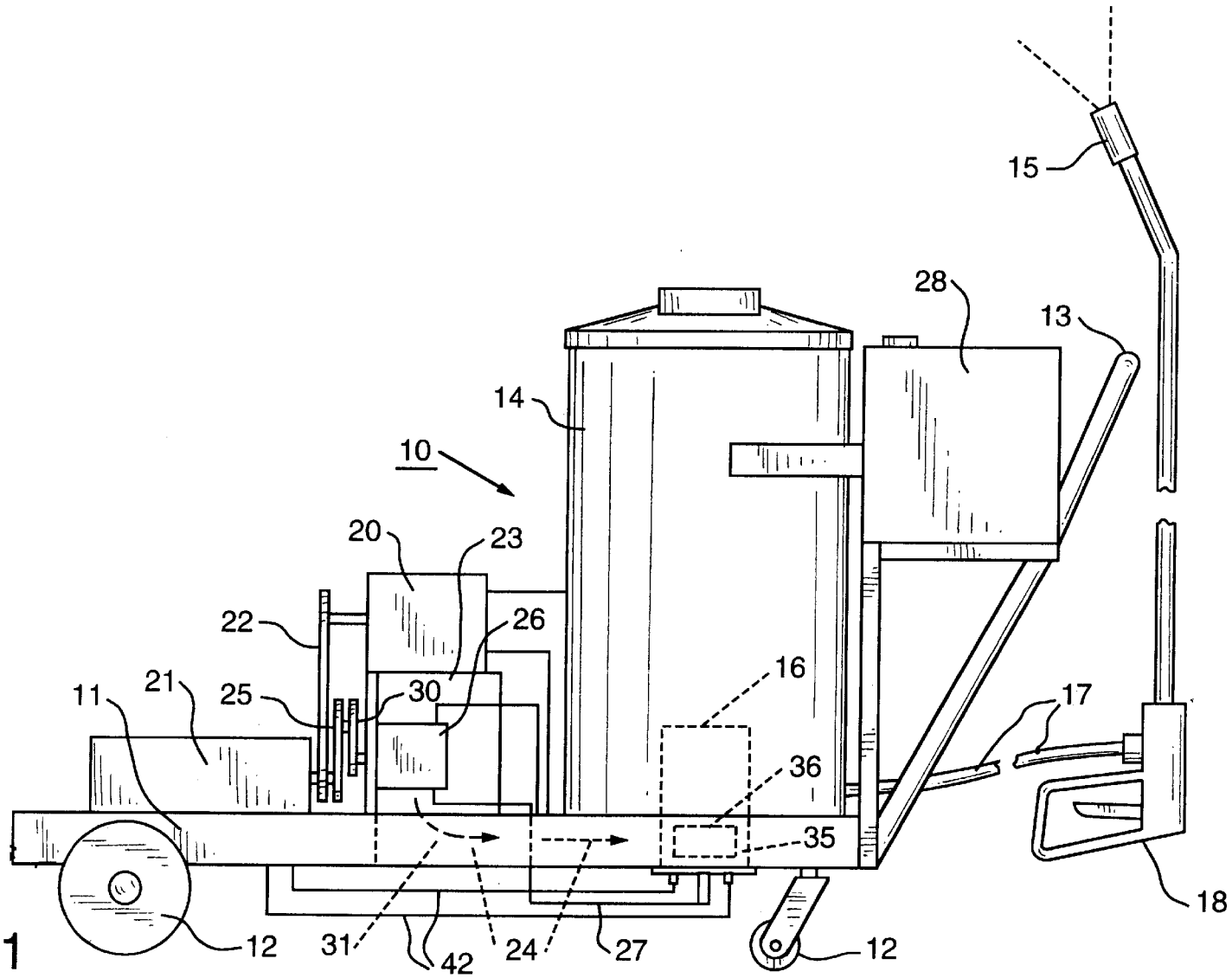
FIG. 1 is a schematic representation in side elevation of the pressure washer of the present invention.
Figure 2:
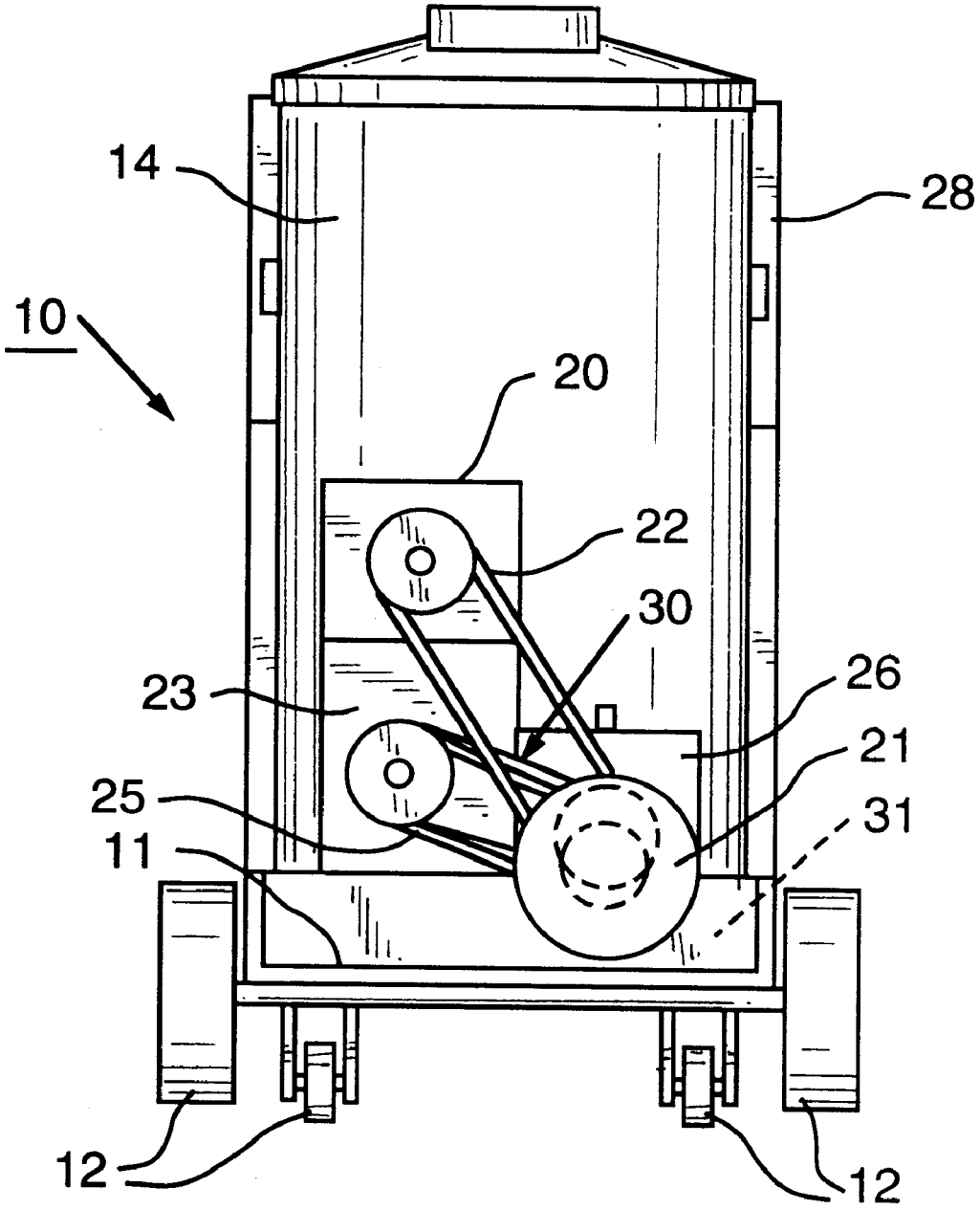
FIG. 2 is a schematic representation of the pressure washer shown in FIG. 1 as seen in left side or end elevation.
Figure 3:
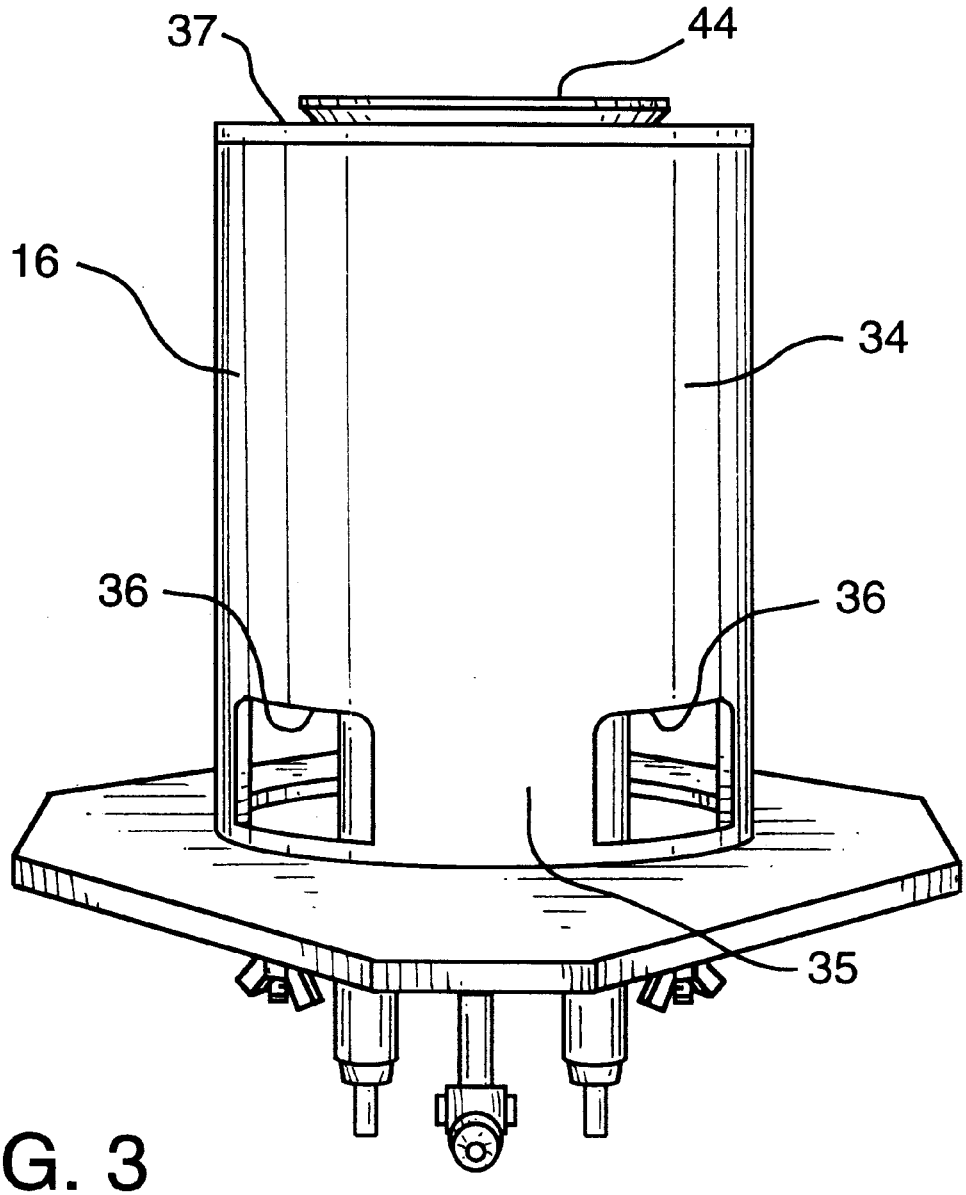
FIG. 3 is an enlarged perspective view of the modular burner unit used in the pressure washer of the FIGS. 1 and 2.
Figure 4:
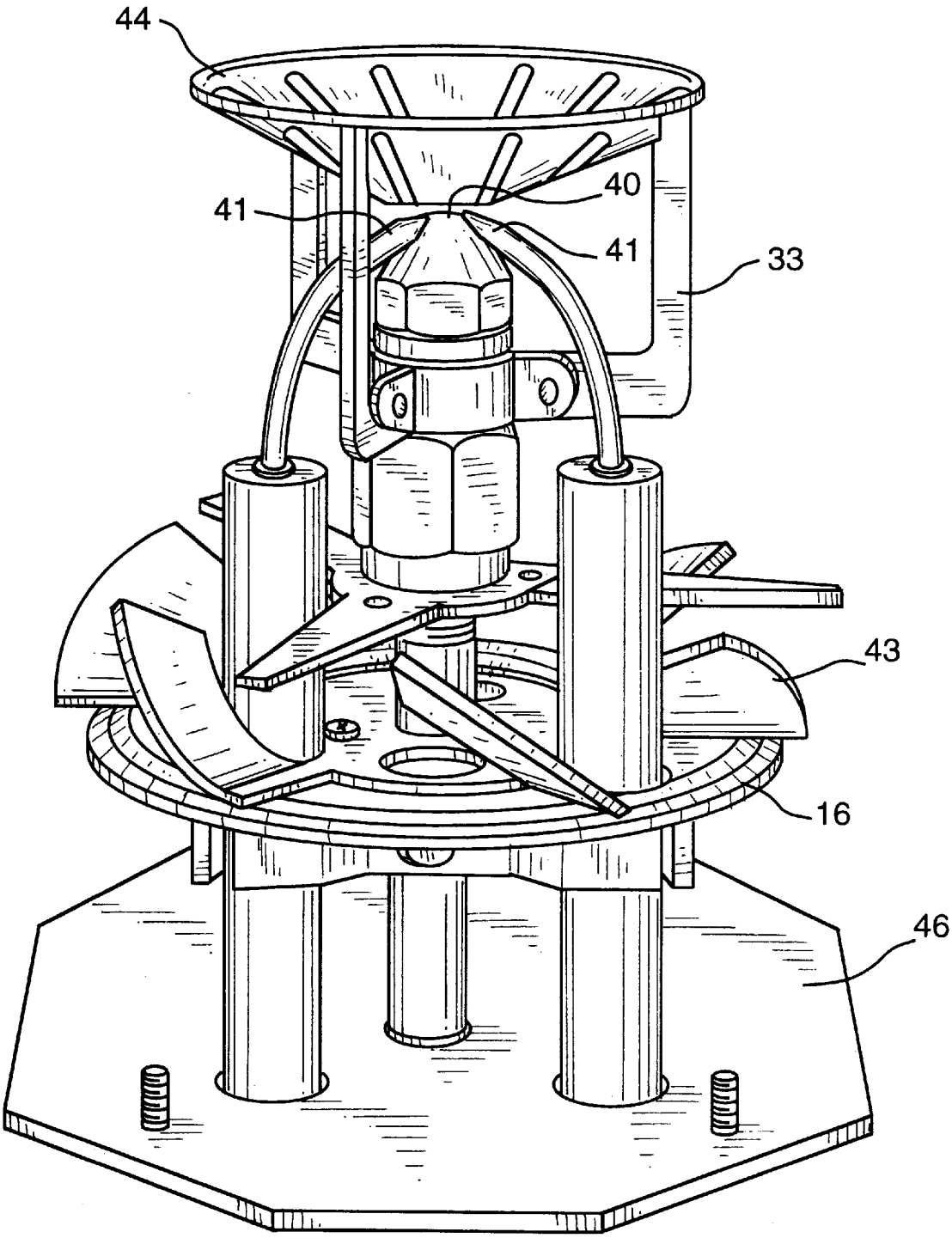
FIG. 4 is an enlarged view of the internal burner assembly of the burner unit shown in FIG. 3 with the outer throat housing removed to expose the burner assembly for viewing.

Referring to the drawings, the pressure washer 10 of the present invention includes a frame 11 supported on wheels 12 for hand manipulation by the use of handle 13.

A heat exchanger 14 is also supported on frame 11 for heating liquid, normally water, passing therethrough under pressure for delivery to washer nozzle 15.

Heat exchanger 14 includes a stacked series of heating pipe coils (not shown) which are heated by oil fired burner unit 16 which is positioned under heat exchanger 14 to apply heat thereto in order to heat liquid passing therethrough. The heated liquid exits nozzle 15 under high pressure via hose connection 17 and wand or gun 18.

Water under pressure is pumped through heat exchanger 14 by way of water pump 20 from a source, such as a supply tank or water supply faucet (not shown). Pump 20 is driven from electric motor 21 by way of pulley belt drive 22.

A blower 23 is also mounted on frame 11 for delivering combustion air under pressure, as indicated by dashed arrows 24 in FIG. 1, to burner units 16. Blower 23 is also driven by electric motor 21 by belt and pulley drive 25.

Fuel pump 26 is also mounted on frame 11 for supplying fuel under pressure to burner unit 16 via fuel line 27 from fuel oil supply tank 28. Fuel pump 26 is directly driven by belt drive 30 from blower 23.

Burner unit 16 is remotely mounted on frame 11 from blower 23 as a readily removable modular unit that is held on by wing nuts so that he entire burner unit 16 may be easily dropped out of the bottom of frame 11 for access and repair or easy serviceability.

This modular burner unit 16 is connected remotely to blower 23 through duct 31, which is in fact provided within the frame work of support frame 11 itself.

The burner unit 16 includes a burner gun or burner gun assembly 33 contained in a removable burner throat housing 34 having a base portion 35 with an air inlet or inlets 36 which register with duct 31 when the burner unit 16 is in its assembled position in the pressure washer 10 as illustrated in FIG. 1.

Throat housing 34 is also provided with an outer flame port 37 for exposure of a flame from burner nozzle 40.

The internal workings of the burner gun or assembly 33 are conventional. An alternating electric twin starter 41 is used to initially ignite the oil fuel being ejected under pressure from nozzle 40 with an alternating spark generated from the twin electric elements in conventional fashion, which electrical energy is supplied through electric wires 42 from an energization source (not shown). An air diffuser 43 is provided to defuse the air supplied from blower 26 and flame cone 44 assists in shaping the flame to a desired configuration.

The throat housing 34 for burner unit 16 properly directs all of the air supplied from lower 23 through duct 31 and inlets 36 to diffuser 43 wherein the air is uniformly diffused and supplied under pressure to burner nozzle 40 for combustion support. The bottom of throat housing 34 is completely closed off by bottom plate 46 of the burner unit.

I claim:

1. A pressure washer including a frame supporting a heat exchanger for heating liquid passing therethrough under pressure for delivery to a nozzle and a burner unit positioned for applying flame heat to said heat exchanger for heating liquid in said heat exchanger and a blower for delivering combustion air under pressure to said burner unit and a fuel pump for supplying fuel under pressure to said burner unit, the improvement comprising:

said burner unit remotely mounted on said frame from said blower as a readily removable modular unit and connected to said blower through a duct; and said burner unit including a burner gun contained in a removable burner throat housing having a base with an air inlet for registration with said duct and an outer flame port for exposure of the flame from said burner gun whereby said burner gun in combination with said burner throat housing are removable from said duct as a modular unit.

2. The pressure washer of claim 1 including a drive connecting said blower to said fuel pump whereby said fuel pump is driven from said blower.

3. The pressure washer of claim 2 including a motor on said frame and connected for simultaneously driving said blower and a liquid pump on said frame for supplying liquid under pressure to said heat exchanger.

4. The pressure washer of claim 1, said throat housing having a top and bottom and comprised of a cylindrical sleeve having at least one side aperture adjacent said bottom thereby providing said base air inlet, and a closure for the bottom of said sleeve.

* * * * *